US007403092B2

(12) United States Patent
Shirai et al.

(10) Patent No.: US 7,403,092 B2
(45) Date of Patent: Jul. 22, 2008

(54) THERMISTOR

(75) Inventors: Satoshi Shirai, Tokyo (JP); Yukie Mori, Tokyo (JP)

(73) Assignee: TDK Corporation, Tokyo (JP)

( * ) Notice: Subject to any disclaimer, the term of this patent is extended or adjusted under 35 U.S.C. 154(b) by 82 days.

(21) Appl. No.: 11/313,626

(22) Filed: Dec. 22, 2005

(65) Prior Publication Data

US 2006/0139141 A1 Jun. 29, 2006

(30) Foreign Application Priority Data

Dec. 28, 2004 (JP) ..... 2004-381183

(51) Int. Cl.
*H01C 7/13* (2006.01)

(52) U.S. Cl. ..... 338/22 R

(58) Field of Classification Search ..... 338/22 R
See application file for complete search history.

(56) References Cited

U.S. PATENT DOCUMENTS 6,558,579 B2 * 5/2003 Handa et al. ..... 252/511
6,558,616 B2 * 5/2003 Ito et al. ..... 419/7
6,842,103 B2 * 1/2005 Yoshinari et al. ..... 338/22 R

FOREIGN PATENT DOCUMENTS

WO WO 2004/086421 A1 10/2004

* cited by examiner

*Primary Examiner*—Elvin Enad
*Assistant Examiner*—Joselito Baisa
(74) *Attorney, Agent, or Firm*—Oliff & Berridge, PLC

(57) ABSTRACT

A thermistor is provided with a pair of opposed electrodes, and a thermistor body layer disposed between the pair of electrodes and including a cured body of a curable resin composition containing a thermosetting resin and conductive particles, and an average particle diameter of secondary particles of the conductive particles is in a range of 3.8 to 17.0 μm.

4 Claims, 1 Drawing Sheet

THERMISTOR

BACKGROUND OF THE INVENTION

1. Field of the Invention

The present invention relates to a thermistor using an organic material as a thermistor body.

2. Related Background Art

A thermistor using a material consisting of a polymer layer and conductive particles dispersed therein as a thermistor body is generally called an organic thermistor or the like and, particularly, one having such a PTC (Positive Temperature Coefficient) characteristic as to quickly increase the resistance with increase of temperature is sometimes called an organic positive characteristic thermistor. The thermistors of this type are applied to such devices as overcurrent/overheat protection elements, self-regulating heat generators, and temperature sensors.

For example, an organic thermistor proposed heretofore is one using a material in which conductive particles are dispersed in an epoxy resin being a thermosetting resin, as a thermistor body (PCT International Publication No. 2004/086421).

SUMMARY OF THE INVENTION

Concerning the conventional organic thermistors, however, the room-temperature resistance was not always sufficiently low and a further improvement has been demanded in this respect. The conventional organic thermistors also had the problem that the room-temperature resistance largely increased by virtue of a thermal history during a reflow step and others for mounting on a substrate, as compared with that before subjected to the thermal history. The increase of the room-temperature resistance would make it difficult to function as a thermistor per se.

An object of the present invention is therefore to provide a thermistor having a sufficiently low initial room-temperature resistance and being capable of maintaining a low room-temperature resistance even after subjected to a thermal history.

The Inventors conducted elaborate research in order to solve the above problem and found that when the conductive particles to be used were those with the cumulative 50% particle diameter of secondary particles thereof in a specific range, the initial room-temperature resistance of the thermistor became adequately low and that the room-temperature resistance was also maintained low after subjected to a thermal history. Then the Inventors conducted further research on the basis of this finding and accomplished the present invention.

Namely, the present invention is a thermistor comprising a pair of opposed electrodes, and a thermistor body layer disposed between the pair of electrodes and including a cured body of a curable resin composition containing a thermosetting resin and conductive particles, wherein a cumulative 50% particle diameter of secondary particles of the conductive particles is in a range of 3.8 to 17.0 μm.

The thermistor of the present invention uses the conductive particles the secondary particles of which have particle diameters whose cumulative 50% particle diameter is in the foregoing specific range, whereby it can have an adequately low initial room-temperature resistance and maintain a low room-temperature resistance even after subjected to a thermal history.

Furthermore, the conductive particles are preferably those wherein $D_{50}/D_{10}$ is in a range of 2.5 to 6.5, where $D_{50}$ and $D_{10}$ are the cumulative 50% particle diameter and a cumulative 10% particle diameter of the secondary particles, respectively.

The value of $D_{50}/D_{10}$ reflects a distributed state of particle diameters of the conductive particles. Namely, for example, by making a comparison on the assumption that $D_{50}$ is constant, as the value of $D_{50}/D_{10}$ increases, the distribution of particle diameters becomes sharper and the rate of particles having the particle diameters near $D_{50}$ increases. This value of $D_{50}/D_{10}$ is used as an index to control the distributed state of particle diameters of secondary particles of the conductive particles, whereby the initial room-temperature resistance and the room-temperature resistance after a thermal history can be kept much lower.

In the thermistor of the present invention a thickness of the thermistor body layer is preferably in a range of 0.2 to 1.0 mm. The Inventors discovered that when the thickness of the thermistor body layer was kept in this specific range in use of the conductive particles with $D_{50}$ in the foregoing specific range, the thermistor provided the effect of suppressing variation in the room-temperature resistance thereof.

DESCRIPTION OF THE PREFERRED EMBODIMENTS

Figure 1:
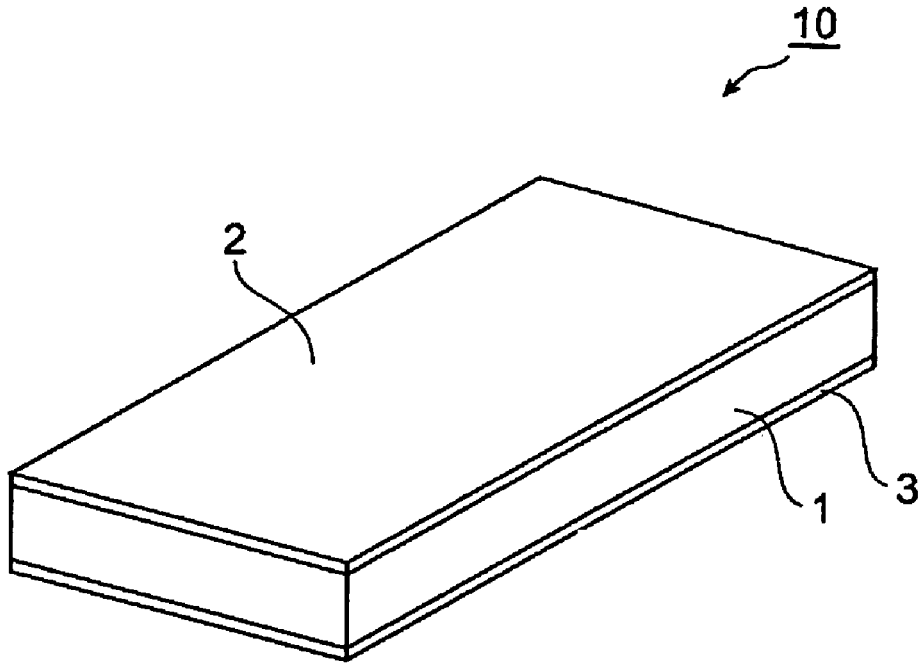
FIG. 1 is a perspective view schematically showing an embodiment of the thermistor according to the present invention.

Preferred embodiments of the present invention will be described below in detail. It is, however, noted that the present invention is by no means intended to be limited to the embodiments described below.

FIG. 1 is a perspective view schematically showing a preferred embodiment of the thermistor according to the present invention. The thermistor 10 shown in FIG. 1 is composed of a pair of electrode 2 and electrode 3 arranged to face each other, and a thermistor body layer 1 provided in close contact with each of the electrodes between electrode 2 and electrode 3 and consisting of a thermistor body having a positive resistance-temperature characteristic, and the whole thermistor is substantially of a rectangular parallelepiped shape. The thermistor 10 may be further provided with a lead (not shown) electrically connected to the electrode 2 and a lead (not shown) electrically connected to the electrode 3 as occasion may demand. This thermistor 10 is suitably applicable to overcurrent/overheat protection elements, self-regulating heat generators, temperature sensors, and so on.

The electrode 2 and electrode 3 are made of a material electrically conductive enough to function as electrodes of the thermistor. The material for the electrode 2 and electrode 3 is preferably a metal such as nickel, silver, gold, or aluminum, or carbon. The thickness of the electrodes is preferably in the range of 1 to 100 μm and more preferably in the range of 1 to 50 μm in terms of reduction in weight of the thermistor. There are no particular restrictions on the shape and material of the leads as long as they have electric conductivity enough to discharge electric charge from the electrode 2 and electrode 3 to the outside or to inject electric charge.

The thickness of thermistor body layer 1 is preferably in the range of 0.2 to 1.0 mm, more preferably in the range of 0.2 to 0.9 mm, and further more preferably in the range of 0.2 to 0.7 mm. If the thickness of thermistor body layer 1 is less than 0.2 mm or more than 1.0 mm, the variation of room-temperature resistance will tend to increase. If the thickness of thermistor body layer 1 is less than 0.2 mm, a short-circuit will tend to occur, so as to fail to achieve a normal room-temperature resistance.

The thermistor body forming the thermistor body layer 1 is comprised of a cured body of a curable resin composition containing a thermosetting resin and conductive particles dispersed therein. The cumulative 50% particle diameter (hereinafter referred to as "$D_{50}$") of secondary particles of the conductive particles in the thermistor body is in the range of 3.8 to 17 μm. This $D_{50}$ is more preferably in the range of 6.75 to 17.0 μm.

$D_{50}$ of the conductive particles is determined based on a cumulative particle size distribution curve which is obtained by measuring particle diameters of secondary particles of the conductive particles and plotting them on a graph having volume % over the whole particles on the vertical axis and particle diameters on the horizontal axis. Namely, in the present invention $D_{50}$ means a value particle diameter) on the horizontal axis at 50 volume % on the vertical axis in the cumulative particle size distribution curve of secondary particles. The cumulative 10% particle diameter (hereinafter referred to as "$D_{10}$") described later also similarly means a value (particle diameter) on the horizontal axis at 10 volume % on the vertical axis in the cumulative particle size distribution curve.

The particle diameters of secondary particles of the conductive particles can be measured, for example, by the laser diffraction method. The laser diffraction method is a particle size measurement method for obtaining a particle size distribution on the basis of a spatial distribution of diffracted light and scattered light upon irradiation of a sample with a laser, and is also sometimes called a laser diffraction/scattering method. The particle diameters measured by this laser diffraction method can be normally regarded as particle diameters of secondary particles formed as a plurality of primary particles of conductive particles are aggregated.

As described above, the Inventors noted the particle diameters of secondary particles of conductive particles and discovered that the initial room-temperature resistance of the thermistor and the room-temperature resistance after subjected to a thermal history were improved by controlling the particle diameters in the specific range.

Furthermore, the conductive particles preferably demonstrate $D_{50}/D_{10}$ in the range of 2.5 to 6.5 and more preferably in the range of 3.4 to 6.5. If $D_{50}/D_{10}$ is less than 2.5, the rate of components with small particle diameters will increase in the conductive particles and, particularly, the room-temperature resistance after subjected to a thermal history will tend to increase. On the other hand, if $D_{50}/D_{10}$ is more than 6.5, the rate of coarse particles will increase and they will tend not to be well kneaded with the resin and thus not to be molded as a thermistor.

In general, conductive particles available as commercial products or the like include large secondary particles and $D_{50}$ thereof is often off the foregoing specific range. Therefore, the conductive particles used in the present invention are prepared, for example, by fast agitating a mixture in which conductive particles are mixed in a thermosetting resin, by means of a stirrer such as a homogenizer, a dispersing machine, a mill, or the like. The conditions for the agitation can be optionally determined by performing the agitation while monitoring change in particle diameters; for example, where the homogenizer is used, the agitation is conducted at the rotational speed in the range of 3000 to 18000 rpm for 3 to 120 minutes, whereby $D_{50}$ of conductive particles can be normally set in the foregoing range. As for $D_{50}/D_{10}$, the agitating means and agitation conditions can be optionally selected so that the value thereof falls in the desired range. A mixture after the agitation is used to prepare a curable resin composition, and it is cured to form the cured body containing the conductive particles having $D_{50}$ in the above specific range.

An average particle diameter of primary particles of the conductive particles is preferably in the range of 0.1 to 7.0 μm and more preferably in the range of 0.5 to 5.0 μm. Here the average particle diameter of primary particles is defined as a value measured by the Fischer subsieve method. Furthermore, the conductive particles are more preferably those having the specific surface area in the range of 0.3 to 3.0 $m^2/g$ and the apparent density of not more than 3.0 $g/cm^3$. The "specific surface area" herein means a specific surface area determined by the nitrogen gas adsorption method based on the BET single-point method.

The conductive particles can be, for example, carbon black, graphite, metal particles, or ceramic conductive particles. Examples of metal material of the metal particles include copper, aluminum, nickel, tungsten, molybdenum, silver, zinc, cobalt, copper powder plated with nickel, and so on. Examples of materials of the ceramic conductive particles include TiC, WC, and so on. These conductive particles can be used alone or in combination of two or more.

The conductive particles are particularly preferably metal particles. When the conductive particles are metal particles, the room-temperature resistance can be further reduced while the resistance changing rate of the thermistor is maintained sufficiently large; for example, they are therefore suitably applicable to cases where the thermistor of the present invention is applied to overcurrent protection elements. Furthermore, among the metal particles, nickel particles are particularly preferred, in terms of chemical stability, e.g., sufficient resistance to oxidation.

There are no particular restrictions on the shape of the conductive particles, and examples of the shape include the spherical shape, flake shape, fiber shape, rod shape, and so on. The shape is preferably one having spiky protrusions on the surface of particles. When the conductive particles are those having the spiky protrusions, tunnel current becomes easier to flow between adjacent particles, so that the room-temperature resistance can be reduced more while the resistance changing rate of the thermistor is secured well. Since the center-center distance between particles can be set larger than that between perfectly spherical particles, it is possible to obtain a much larger resistance changing rate. Furthermore, the variation in the room-temperature resistance of the thermistor can be more reduced than in the case using particles of fiber shape.

The conductive particles with spiky protrusions commercially available can be, for example, "INCO Type210," "INCO Type255," "INCO Type270," INCO Type287" (all of which are trade names of INCO Ltd.), and so on.

The content of the conductive particles in thermistor body layer 1 is preferably in the range of 65 to 80% by mass, based on the entire thermistor body layer 1. If the content of the conductive particles is less than 65% by mass, it will tend to be difficult to obtain a low room-temperature resistance. If the content of the conductive particles is over 80% by mass, it will tend to be difficult to obtain a large resistance changing rate.

The cured body forming the thermistor body layer 1 is formed by thermally curing a curable resin composition containing a thermosetting resin including a cross-linking resin such as epoxy resin, phenol resin, unsaturated polyester resin, urea resin, melamine resin, furan resin, or polyurethane resin, and a curing agent thereof. This curing agent may be one reacting with the cross-linking resin such as epoxy resin to form a part of a crosslinked structure in the cured body, or one acting as a catalyst in the curing reaction. Another example of the curing agent is one acting as a catalyst and forming a part of the cross-linking structure.

The thermosetting resin is particularly preferably an epoxy resin composition containing an epoxy resin and a curing agent thereof.

In the present invention, the epoxy resin means a resin consisting of a polyepoxy compound or plural types of polyepoxy compounds having a plurality of epoxy groups. Examples of the polyepoxy compound include polyglycidyl ethers of polyhydric phenols such as bisphenol A, bisphenol F, bisphenol AD, catechol, resorcinol, and tetramethyl biphenyl; alkylene oxide adducts of bisphenol compounds; polyglycidyl ethers of polyhydric alcohols such as glycerin and polyalkylene glycol; and polyglycidyl esters of polycarboxylic acids such as phthalic acid and terephthalic acid.

The polyepoxy compound in the epoxy resin is preferably one having a soft segment consisting of a linear divalent organic group or an alicyclic structure consisting of a divalent alicyclic group. By using the polyepoxy compound having the soft segment or the alicyclic structure, it becomes feasible to maintain the room-temperature resistance after subjected to a thermal history, at a further lower level.

Examples of the soft segment include linear structures derived from polyoxy alkylenes, polyalkylenes, polysiloxanes, aliphatic acids, polybutadienes, butadiene-acrylonitrile copolymers, polybutylenes, and so on. Examples of the polyoxy alkylenes include polyoxyethylene, polyoxypropylene, polyoxy tetramethylene, and so on; examples of the polyalkylenes include polyethylene, polypropylene, etc.; and examples of the polysiloxanes include polydimethyl siloxane and others.

The polyepoxy compound with the soft segment of the linear structure derived from the polyoxy alkylenes is preferably a polyglycidyl ether of an alkylene oxide adduct of a bisphenol compound. Specific preferred examples of the polyepoxy compound include those represented by General Formula (1) or (2) below. In the Formulae (1) and (2), $n^1$, $n^2$, $n^3$, and $n^4$ each independently represent an integer of not less than 1. $n^1$, $n^2$, $n^3$, and $n^4$ are preferably 1 to 20.

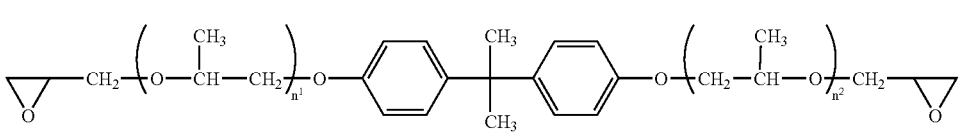

(1)

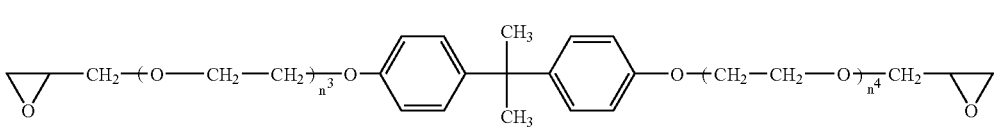

(2)

Other preferred examples of the polyepoxy compound having the soft segment include rubber-modified epoxy resins obtained, for example, by reaction between carboxyl groups of a butadiene-acrylonitrile copolymer (acrylonitrile-butadiene rubber) and epoxy groups of a polyepoxy compound, epoxy-modified polysilicones having an epoxy group at an end, polyepoxy compounds obtained by reaction between an amino-modified polysilicone and a polyepoxy compound, polyepoxy compounds obtained by reaction between isocyanate groups in a polyurethane prepolymer and hydroxyl groups in a polyepoxy compound, and so on.

In the polyepoxy compound having the alicyclic structure, the alicyclic group is a divalent cyclic structure essentially consisting of a saturated hydrocarbon, and embraces one including a different atom such as an oxygen atom, a nitrogen atom, or a sulfur atom as an atom forming a ring, and one having an unsaturated bond in part. This alicyclic group may have a substituent. For enhancing the flexibility of the cured body, this alicyclic group is preferably a divalent group consisting of a cyclohexane ring, a cyclopentane ring, or a dicyclopentadiene ring, and particularly preferably a divalent group consisting of a cyclohexane ring or a cyclopentane ring.

Specific preferred examples of the polyepoxy compound having the alicyclic structure include, for example, those represented by Chemical Formula (3), (4), (5), (6), (7), or (8) below. Among these, particularly preferred polyepoxy compounds are those represented by Formula (3), (4), or (5).

(3)

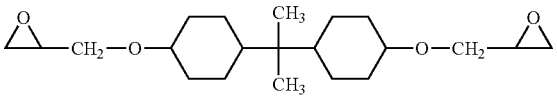

(4)

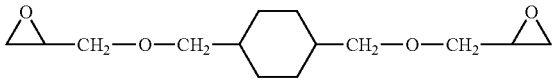

(5)

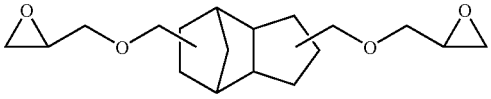

-continued (6)

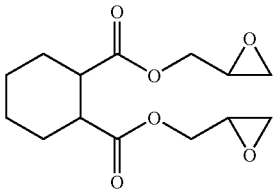

-continued (7)

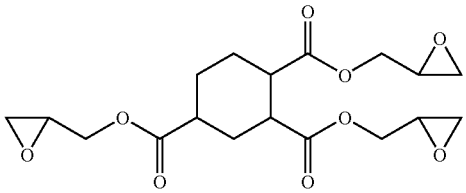

(8)

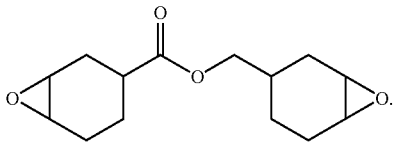

The epoxy resin preferably contains 3 to 100% by mass of the polyepoxy compound having the soft segment or the alicyclic structure, based on the entire epoxy resin, and more preferably 10 to 90% by mass of the polyepoxy compound.

Examples of the curing agent to be used in combination with the epoxy resin include acid anhydrides, aliphatic polyamines, aromatic polyamines, polyamides, polyphenols, polymercaptans, tertiary amines, Lewis acid complexes, and so on. Among these, the acid anhydrides are preferred. Use of the acid anhydrides will tend to reduce the initial room-temperature resistance of the thermistor and to increase the resistance changing rate, when compared with amine-based curing agents such as aliphatic polyamines.

Examples of the acid anhydrides include dodecenyl succinic anhydride, polyadipic anhydride, polyazelaic anhydride, polysebacic anhydride, poly(ethyloctadecanedioic) anhydride, poly(phenylhexadecanedioic) anhydride, 2,4-diethylglutaric anhydride, ethylene glycol bis-anhydrotrimellitate, glycerol tris-trimellitate, hexahydrophthalic anhydride, methylhexahydrophthalic anhydride, tetrahydrophthalic anhydride, methyltetrahydrophthalic anhydride, phthalic anhydride, succinic anhydride, trimellitic anhydride, pyromellitic anhydride, methylnadic anhydride, maleic anhydride, benzophenonetetracarboxylic anhydride, ethylene glycol bis-trimellitate, endomethylene tetrahydrophthalic anhydride, methyl endomethylene tetrahydrophthalic anhydride, methyl butenyl tetrahydrophthalic anhydride, methylcyclohexene dicarboxylic anhydride, alkylstyrene-maleic anhydride copolymers, chlorendic anhydride, tetrabromophthalic anhydride, and so on.

Among these, in terms of enhancing the effect of maintaining the room-temperature resistance low after the thermal history, the acid anhydride suitably applicable is at least one acid anhydride selected from the group consisting of dodecenyl succinic anhydride, polyadipic anhydride, polyazelaic anhydride, polysebacic anhydride, poly(ethyloctadecanedioic) anhydride, poly(phenylhexadecanedioic) anhydride, 2,4-diethylglutaric anhydride, ethylene glycol bis-anhydrotrimellitate, and glycerol tris-trimellitate. Furthermore, the dodecenyl succinic anhydride is preferred among these.

In the epoxy resin composition, the acid anhydrides as described above can be used alone or in combination of two or more.

The content of the curing agent in the thermosetting resin may be optionally determined according to the type of the cross-linking compound or the curing agent, or the like. For example, in a case where the acid anhydride is used as a curing agent in combination with the epoxy resin, the curing agent is preferably contained in the content of 0.5 to 1.5, more preferably 0.8 to 1.2, as an equivalent ratio relative to epoxy groups in the epoxy resin. If the equivalent ratio of the curing agent is less than 0.5 or more than 1.5 relative to the epoxy groups, unreacted epoxy groups and acid anhydride groups will increase and they will tend to decrease the mechanical strength of thermistor body layer 1 and the resistance changing rate of the thermistor.

The thermosetting resin may contain an additive such as a reactive diluent or a plasticizer. The reactive diluent, particularly in the case of combination with the epoxy resin, is preferably a monoepoxy compound. Examples of the monoepoxy compound include n-butyl glycidyl ether, allyl glycidyl ether, 2-ethylhexyl glycidyl ether, styrene oxide, phenyl glycidyl ether, cresyl glycidyl ether, p-sec-butyl phenyl glycidyl ether, glycidyl methacrylate, tertiary glycidyl carbonate, and so on. The plasticizer is preferably a polyhydric alcohol such as polyethylene glycol or propylene glycol.

Still another component, e.g., a thermoplastic resin, or a low-molecular-weight organic compound such as wax, oil and fat, fatty acid, or higher alcohol, or the like may be further added to the thermosetting resin as occasion may demand. The thermoplastic resin may be dissolved in the thermosetting resin or dispersed in the form of particles.

The thermistor 10 can be fabricated by a production method comprising a resin composition preparing step of preparing a curable resin composition in which conductive particles with the cumulative 50% particle diameter of secondary particles thereof being in the range of 3.8 to 17 μm are dispersed in a thermosetting resin; a resin composition layer forming step of obtaining a laminate in which a resin composition layer consisting of the curable resin composition is formed on a first conductor foil; a laminating step of laminating a second conductor foil or another laminate on the aforementioned laminate so that the resin composition layer is sandwiched between a pair of opposed conductor foils, thereby obtaining a sandwich body; a curing step of heating the sandwich body to cure the curable resin composition; and a cutting step of cutting the sandwich body in a predetermined shape and size to obtain a thermistor.

In the resin composition preparing step, a mixture of the foregoing components is quickly stirred, for example, using one of various stirrers such as a homogenizer, or a device such as a dispersing machine or a mill, as described above, thereby to obtain the curable resin composition in which the conductive particles with $D_{50}$ in the aforementioned specific range are dispersed. The curable resin composition after stirred is preferably defoamed under vacuum, in order to remove mixed air bubbles.

In the resin composition layer forming step, for example, the curable resin composition obtained in the above step is applied onto the conductor foil, thereby forming the resin composition layer. At this time, for reduction of viscosity, an organic solvent such as alcohol or acetone, or a solvent such as a reactive diluent may be added into the curable resin composition and the resin composition layer may be formed using it. When the organic solvent is used, it is preferable to remove the solvent, for example, by heating the resin composition layer.

In the laminating step, the second conductor foil or other laminate is laminated on the resin composition layer so that the resin composition layer is sandwiched between a pair of opposed conductor foils, whereby the sandwich body is obtained. At this time, it is preferable to apply a pressure to the whole so as to achieve close contact between the conductor foils and the resin composition layer.

In the curing step, the sandwich body is heated at a predetermined temperature for a predetermined time so as to adequately cure the curable resin composition forming the resin composition layer. The conditions for the heating at this time may be optionally set according to the type of the curing agent or the like, and, for example, where an acid anhydride is used as a curing agent, curing can be normally made to proceed well, by heating under the conditions of 80 to 200° C. and 30 to 600 minutes. This curing step may be conducted under pressure and, in this case, the laminating step and the curing step may be carried out simultaneously or continuously.

In the cutting step, the sandwich body resulting from the curing of the curable resin composition is cut in a desired shape (e.g., 3.6 mm×9 mm) by punching or the like, whereby the thermistor 10 can be obtained. The punching can be performed by a method normally used for acquisition of the thermistor, e.g., a cat press.

Furthermore, leads are joined to the respective surfaces of electrodes 2 and 3 of conductor foils, if necessary, to fabricate a thermistor with leads.

In general, an effective means for reducing the room-temperature resistance is to increase the proportion of conductive particles in the thermistor body. However, the increase in the proportion of conductive particles results in significant increase in the viscosity of the curable resin composition and it thus becomes difficult to apply the resin composition layer in a small thickness, or to make the thermistor body layer thinner by applying pressure in the laminating step and in the curing step. Therefore, it was extremely difficult to form a thin thermistor body layer, e.g., in the thickness of 0.2 to 1.0 mm while the conductive particles were contained in the proportion enough to achieve an adequately low room-temperature resistance (e.g., 65 to 80% by mass, based on the entire thermistor body layer), in the curable resin composition. In contrast to it, when the conductive particles dispersed in the curable resin composition for formation of the thermistor body layer have $D_{50}$ in the aforementioned specific range, the room-temperature resistance can be made adequately low without extreme increase in the viscosity of the curable resin composition. Therefore, it is feasible to readily produce even the thermistor with the thermistor body layer in a sufficiently small thickness.

Instead of the above-described production method, the thermistor 10 can also be obtained, for example, by a method of preparing a thermistor body of sheet shape and forming conductor layers on both surfaces of this thermistor body of sheet shape. In this case, the thermistor body of sheet shape can be made, for example, by a method of curing the curable resin composition in a state in which it is sandwiched between a pair of releasable support sheets facing each other, and releasing the support sheets. In this method the conductor layers can be formed by a method, for example, such as plating, application of a metal paste, sputtering, or evaporation.

The thermistor described above is able to maintain an adequately low room-temperature resistance even after the reflow step, This thermistor is also excellent in the other properties required for the thermistor, e.g., a low initial resistance, a large resistance changing rate, and so on.

EXAMPLES

The present invention will be more specifically described below with Examples and Comparative Examples. It is, however, noted that the present invention is by no means limited to these examples.

Example 1

Preparation of Curable Resin Composition for Formation of Thermistor Body Layer Nickel particles as conductive particles (available from NIKKO RICA Corp.) were added in an amount of 75% by mass relative to the whole curable resin composition including the nickel particles, into a mixture in which "ADEKA RESIN EP-4005" (trade name of ASAHI DENKA Co., Ltd.) as an epoxy resin and "EPICLON B-570" (trade name of DAINIPPON INK AND CHEMICALS, Inc.) as an acid anhydride-based curing agent were mixed. Then the whole mixture was mixed at the rotational speed of 5000 rpm for 50 minutes, using a homogenizer ("CELL MASTER" (trade name) available from AS ONE Corp.), to obtain a curable resin composition for formation of the thermistor body layer.

Measurement of Particle Diameters of Ni Particles

A part of the resultant curable resin composition was taken out and dissolved in acetone to remove the resin component and to obtain a sample of Ni particles for measurement of particle diameters. The sample thus obtained was analyzed to measure particle diameters by the laser diffraction method using a Microtrac particle size distribution analyzer ("9320HRA (X-100)" (trade name) available from NIKKISO Co., Ltd.), thereby obtaining a volume-base cumulative particle size distribution curve of secondary particles. The measurement of particle diameters was performed in a state in which Ni particles were dispersed in a 0.5% sodium hexametaphosphate water solution.

The cumulative 50% particle diameter $D_{50}$ determined from the resultant cumulative particle size distribution curve was 17.00 μm and the cumulative 10% particle diameter $D_{10}$ 2.62 μm.

Fabrication of Thermistor and Evaluation Thereof

The curable resin composition obtained above was defoamed under reduced pressure and thereafter applied onto an Ni foil as an electrode to form a resin composition layer. Subsequently, another Ni foil as a counter electrode was mounted on the resin composition layer and the entire laminate was pressed into a sheet shape under heating at 130° C. for ten hours to effect curing, thereby obtaining a sandwich body in which a thermistor body layer (thickness: 0.5 mm) was sandwiched between a pair of electrodes (Ni foils). Furthermore, the resultant sandwich body was punched into a predetermined size by a cat press to obtain a thermistor.

The thermistor was heated with increasing temperature at the rate of 3° C./min from room temperature to 200° C. in a thermostatic chamber, and thereafter cooled with decreasing temperature at the same rate. At this time, the resistance of the thermistor was measured by the four-terminal method to obtain a temperature-resistance curve. It was confirmed from the obtained temperature-resistance curve that the initial room-temperature (25° C.) resistance of the thermistor was 1.2 mΩ. In order to subject the obtained thermistor to a thermal history assumed to be a reflow step, the thermistor was put in a reflow furnace at 275° C. for two minutes. The room-temperature resistance after the thermal history was 10.8 mΩ.

Examples 2, 3 and Comparative Examples 1, 2

The preparation of the curable resin composition, the measurement of particle diameters of Ni particles, the fabrication of the thermistor, and the evaluation thereof were conducted in the same manner as in Example 1, except that the rotational speed of the homogenizer in the preparation of the curable resin composition was changed to the rotational speeds shown in Table 1. In the case of Comparative Example 1, however, kneading was insufficient and it resulted in failure in forming the curable resin composition in sheet shape and thus failure in fabrication of the thermistor. The particle diameters of Ni particles and the room-temperature resistances of the thermistors obtained are presented together in Table 1.

Reference Example 1

The preparation of the curable resin composition, the measurement of particle diameters of Ni particles, the fabrication of the thermistor, and the evaluation thereof were conducted in the same manner as in Example 1, except that the proportion of Ni in the curable resin composition was 60% by mass and the preparation of the curable resin composition was performed at the rotational speed of 180 rpm for 45 minutes, using a stirrer with stirring blades ("Tornado" (trade name) available from AS ONE Corp.), instead of the homogenizer. The particle diameters of Ni particles and the room-temperature resistance of the thermistor are presented in Table 1.

Reference Example 2

The preparation of the curable resin composition and the measurement of particle diameters of Ni particles were conducted in the same manner as in Reference Example 1, except that the proportion of Ni in the curable resin composition was 75% by mass. The fabrication of the thermistor body was attempted using the resultant curable resin composition, but it was hard to form it in sheet shape because of insufficient kneading. Therefore, the evaluation of the thermistor body was not performed.

TABLE 1

| | Amount of Ni particles (% by mass) | Stirring | Particle diameters $D_{50}$ | Particle diameters $D_{10}$ | Ratio of particle diameters $D_{20}/D_{10}$ | Room temperature resistance (mΩ) Initial | Room temperature resistance (mΩ) After heat history | Resistance changing rate (digit (number) |
|---|---|---|---|---|---|---|---|---|
| Example 1 | 75 | homogenizer 5000 rpm | 17.00 | 2.62 | 6.50 | 1.2 | 10.8 | 7 |
| Example 2 | 75 | homogenizer 10000 rpm | 6.75 | 1.98 | 3.41 | 1.3 | 19.9 | 7 |
| Example 3 | 75 | homogenizer 15000 rpm | 3.80 | 1.52 | 2.50 | 3.3 | 30.4 | >10 |
| Comparative Example 1 | 75 | homogenizer 500 rpm | 20.13 | 2.86 | 7.04 | — | — | — |
| Comparative Example 2 | 75 | homogenizer 20000 rpm | 3.70 | 1.51 | 2.48 | 5.2 | 105.3 | >10 |
| Reference Example 1 | 60 | stirring blades, 180 rpm | — | — | — | 10 | — | >10 |
| Reference Example 2 | 75 | stirring blades, 180 rpm | — | — | — | — | — | — |

Example 4

Twenty thermistors were fabricated in the same manner as in Example 2 except that the thickness of the thermistor body layer was 2.00 mm. The temperature-resistance curve was obtained for each of the twenty thermistors in the same manner as in Example 1, and the room-temperature resistance and resistance changing rate of each thermistor were determined therefrom. From the room-temperature resistances thus obtained, a minimum, a maximum, and an average were determined, and a ratio of a difference between the maximum and the minimum to the average was defined as a variation rate of the resistances.

Examples 5, 6, 7, 8 and Reference Example 3

The minimum, maximum, and average of room-temperature resistances were determined in the same manner as in Example 4, except for the thickness of the thermistor body layer was changed as shown in Table 2, and the ratio of the difference between the maximum and the minimum to the average was defined as a variation rate of resistances.

TABLE 2

| | Thickness of thermistor element layer (μm) | Room-temperature resistance Min. | Room-temperature resistance Max. | Room-temperature resistance Difference between max and min | Variation rate (difference/average | Resistance changing rate (digit number) |
|---|---|---|---|---|---|---|
| Example 4 | 2.00 | 11.04 | 27.69 | 16.65 | 0.860 | >10 |
| Example 5 | 1.00 | 2.02 | 4.58 | 2.56 | 0.776 | >10 |
| Example 6 | 0.50 | 0.90 | 1.60 | 0.70 | 0.560 | 7 |
| Example 7 | 0.35 | 0.50 | 0.80 | 0.30 | 0.462 | 5 |
| Example 8 | 0.20 | 0.04 | 0.06 | 0.02 | 0.400 | 5 |
| Reference Example 3 | 0.10 | 0.02 | 0.03 | 0.01 | 0.400 | — |

As seen from Table 1, the thermistors in Examples 1-3 with the cumulative 50% particle diameter $D_{50}$ of Ni particles being in the range of 3.8 to 17.0 demonstrated clearly lower values of the initial room-temperature resistance and the room-temperature resistance after the thermal history than in Comparative Example 2 whose $D_{50}$ was off the range of 3.8 to 17.0. As apparent from the comparison with Reference Example 1 and Reference Example 2, it was confirmed that if the content of Ni particles was too large it would result in a tendency to cause a hindrance to the fabrication of the thermistor.

Furthermore, it was confirmed from Table 2 that the variation in the room-temperature resistance was adequately suppressed by decreasing the thickness of the thermistor body layer to not more than 1.00 mm. It was, however, confirmed that if the thickness of the thermistor body layer was decreased to less than 0.20 μm, as in Reference Example 3, a short-circuit occurred so as to fail to obtain a resistance changing rate and the thermistor could fail to operate normally.

The present invention provides the thermistor having an adequately low initial room-temperature resistance and being capable of maintaining a low room-temperature resistance even after subjected to a thermal history.

What is claimed is:

1. A thermistor comprising:

a pair of opposed electrodes; and a thermistor body layer disposed between said pair of opposed electrodes and including a cured body of a curable resin composition containing a thermosetting resin and conductive particles, wherein a cumulative 50% particle diameter of secondary particles of the conductive particles is in a range of 3.8 to 17.0 μm, and a content of the conductive particles is in a range of 65 to 80% of an entire mass of said thermistor body layer.

2. A thermistor according to claim 1, wherein, where $D_{50}$ and $D_{10}$ represent the cumulative 50% particle diameter and a cumulative 10% particle diameter, respectively, of the secondary particles of the conductive particles, $D_{50}/D_{10}$ is in a range of 2.5 to 6.5.

3. A thermistor according to claim 2, wherein a thickness of the thermistor body layer is in a range of 0.2 to 1.0 mm.

4. A thermistor according to claim 1 wherein a thickness of the thermistor body layer is in a range of 0.2 to 1.0 mm.

* * * * *